US012330894B2

(12) United States Patent
Roehrborn et al.

(10) Patent No.: US 12,330,894 B2
(45) Date of Patent: Jun. 17, 2025

(54) SYSTEM AND METHOD FOR STABILIZING WEB POSITION DURING SPLICING OF TRANSVERSELY WOUND MATERIAL ROLLS

(71) Applicant: CURT G. JOA, INC., Sheboygan Falls, WI (US)

(72) Inventors: Scott A. Roehrborn, Sheboygan, WI (US); Jason J. Reineking, Sheboygan, WI (US); Terry J. Henrickson, Manitowoc, WI (US); Song V. Sayaovong, Milwaukee, WI (US); Anthony J. Eisner, Sr., Sheboygan, WI (US)

(73) Assignee: Curt G. Joa, Inc, Sheboygan Falls, WI (US)

( * ) Notice: Subject to any disclaimer, the term of this patent is extended or adjusted under 35 U.S.C. 154(b) by 330 days.

(21) Appl. No.: 18/299,112

(22) Filed: Apr. 12, 2023

(65) Prior Publication Data

US 2023/0339714 A1 Oct. 26, 2023

Related U.S. Application Data

(60) Provisional application No. 63/334,391, filed on Apr. 25, 2022.

(51) Int. Cl.
*B65H 19/18* (2006.01)

(52) U.S. Cl.
CPC ..... *B65H 19/1852* (2013.01); *B65H 19/1863* (2013.01); *B65H 19/1868* (2013.01); *B65H 2301/4611* (2013.01)

(58) Field of Classification Search
CPC ..... B65H 19/1805; B65H 19/1826; B65H 19/1831; B65H 19/1836; B65H 19/18–1894; B65H 21/00; B65H 2301/46; B65H 2301/4601; B65H 2301/46013; B32B 38/18; B29C 66/1122; B29C 66/1142; B29C 66/855
See application file for complete search history.

(56) References Cited

U.S. PATENT DOCUMENTS 3,589,100 A 6/1971 Konars et al.
4,443,291 A 4/1984 Reed
(Continued)

FOREIGN PATENT DOCUMENTS

CN 109758301 A 5/2019
EP 2013127 B1 1/2009
(Continued)

*Primary Examiner* — Carson Gross
(74) *Attorney, Agent, or Firm* — Klintworth & Rozenblat LLP

(57) ABSTRACT

A system and method for the splicing transversely wound webs is provided. A web diverter unit includes a web retaining assembly movable between a first position where the web retaining assembly is not in contact with the running web and a second position where the web retaining assembly is in contact with the running web. With the web retaining assembly in the second position, the web retaining assembly temporarily holds the running web being unwound off of the running web material roll at a constant transverse position to enable precise alignment of the running web with the waiting web for splicing therebetween.

15 Claims, 11 Drawing Sheets

(56) References Cited

U.S. PATENT DOCUMENTS

| | | | | |
|---|---|---|---|---|
| 5,643,395 | A | 7/1997 | Hinton | |
| 6,676,062 | B1 | 1/2004 | Herhaus | |
| 6,701,992 | B1 * | 3/2004 | Pasquale | B65H 21/00 156/304.3 |
| 6,802,110 | B2 | 10/2004 | Berweger et al. | |
| 6,827,804 | B2 | 12/2004 | Otsubo et al. | |
| 6,837,958 | B2 | 1/2005 | Otsubo et al. | |
| 7,243,404 | B2 | 7/2007 | Weiss | |
| 7,464,516 | B2 | 12/2008 | Johnson | |
| 8,439,813 | B2 | 5/2013 | Back et al. | |
| 8,740,128 | B2 | 6/2014 | Oravits et al. | |
| 10,098,792 | B2 | 10/2018 | Schneider et al. | |
| 10,329,110 | B2 | 6/2019 | Dotta | |
| 10,518,996 | B2 | 12/2019 | Adami | |
| 11,007,092 | B2 | 5/2021 | Sauer et al. | |
| 11,020,282 | B2 | 6/2021 | Bäck et al. | |
| 11,117,771 | B2 | 9/2021 | Hada et al. | |
| 2002/0117575 | A1 | 8/2002 | Gilmore et al. | |
| 2008/0169373 | A1 | 7/2008 | Andrews et al. | |
| 2017/0101281 | A1 * | 4/2017 | Follen | A61F 13/15804 |
| 2017/0172814 | A1 | 6/2017 | Wagner et al. | |
| 2022/0324669 | A1 | 10/2022 | Follen et al. | |

FOREIGN PATENT DOCUMENTS

| | | | |
|---|---|---|---|
| EP | 2133297 | B1 | 4/2016 |
| EP | 3322658 | B1 | 5/2018 |
| EP | 3346964 | B1 | 7/2018 |
| JP | 06495680 | B2 | 4/2019 |

* cited by examiner

SYSTEM AND METHOD FOR STABILIZING WEB POSITION DURING SPLICING OF TRANSVERSELY WOUND MATERIAL ROLLS

BACKGROUND OF THE DISCLOSURE

Embodiments of the disclosure relate to a system and method for making disposable garments and, more specifically, to a system and method for the splicing of material rolls that provide webs used in the manufacture of a disposable garment assembly or absorbent sanitary product.

The manufacture of many types of web-based, disposable garments or products is often performed as a continuous process where materials and/or components used to create the garment are continuously advanced as part a production flow for the garment. For example, in some processes of manufacturing and assembling disposable wearable garments, advancing webs of material are combined with other advancing webs of material, while in other processes individual components are combined with advancing webs of material that, in turn, may then be combined with other advancing webs of material.

One particular example of such a process regards the manufacture and assembly of absorbent sanitary articles, which may be manufactured and assembled by adding components to and/or otherwise modifying an advancing, continuous web of material. In absorbent sanitary articles such as diapers, incontinence, and feminine hygiene products, as examples, the various webs of material and component parts may include backsheets, topsheets, leg cuffs, waist bands, absorbent core components including acquisition and/or distribution layers, front and/or back ears, fastening components, and various types of elastic webs and components such as leg elastics, barrier leg cuff elastics, stretch side panels, and waist elastics.

Typically, most of the raw materials used in the manufacture of a disposable wearable garment—such as the web materials—are provided in roll form and unwound and applied in a continuously fed fashion. Usage and application of the web to a disposable garment assembly thus involves the unwinding of a roll of web material. In the prior art, web unwinding units (e.g., turret unwind units) exist that provide for the unwinding of a first or running web material roll of material and for the positioning of a second or new roll of material that may be spliced with the running web material roll as the running web material roll nears expiration. At or near the expiration of the running web material roll, the web material on the running web material roll is spliced with the web material on the new web material roll—with the engagement of the web material on the new web material roll occurring by splicing the web being unwound from the running web material roll thereto. After splicing, the running web material roll stops with some raw material remaining on the core, and the new web material roll is unwound to continue feeding a web into the disposable garment assembly.

In the manufacture of some disposable wearable garments, the web that is unwound from each respective web material roll is a narrow web having a width that is less than the overall material roll, and the web is wound on the material roll in a transverse wind pattern, such as a helical wind or according to a step pattern in which several winds of the material are made a given transverse location on the roll before the wind location shifts to a new transvers location approximately equal to or less than the web width to the side of the previous wind location. Due to this transverse wrapping pattern of the web on the material roll, a transverse position of the web along the material roll varies as the web is unwound by the web unwinding unit. While this variation of the transverse position of the web during unwinding is accommodated during the manufacturing process and inconsequential to a downstream processing of the web, the variation of the transverse position of the web can make it difficult to splice the running web from the expiring roll to the waiting web of the new material roll. That is, due to the transverse position of the running web changing during the unwinding thereof, it can be difficult to align the running web in the transverse direction with the waiting web to achieve an acceptable splicing of the webs.

In performing a splicing operation with transversely wound material rolls, existing splicing systems typically attempt (via system controls and web monitoring) to anticipate a transverse location at which the running web will be at a certain time, such as when the running web will be at dead center of the expiring material roll, and then time the splicing to when the web is anticipated to be at that location. However, the anticipated transverse location of the running web estimated by the splicing system may not always be accurate, leading to an occurrence of a splice failure due to misalignment of the running web with the waiting web.

It is therefore desirable to provide an improved system and method for splicing the webs of transversely wound material rolls during manufacture of disposable garments.

BRIEF DESCRIPTION OF THE DISCLOSURE

Embodiments of the disclosure are expressed and characterized in the independent claims, while the dependent claims explain other characteristics and variants of the disclosure. The characteristics and variants described in the dependent claims may be used in combination with or in isolation from each other, according to embodiments of the disclosure.

In accordance with some embodiments, a web unwinding and splicing system includes a turret unwind unit configured to hold a running web material roll and a new web material roll and to unwind a running web from the running web material roll, the running web having a web width less than a roll width of the running web material roll and being wound onto the running web material roll such that a transverse position of the running web on the running web material roll varies as the running web is unwound therefrom. The system also includes a web splicing unit operable with the turret unwind unit to selectively splice the running web of the running web material roll with a waiting web of the new web material roll. The system further includes a web diverter unit having a web retaining assembly movable between a first position where the web retaining assembly is not in contact with the running web and a second position where the web retaining assembly is in contact with the running web. With the web retaining assembly in the second position, the web retaining assembly temporarily holds the running web being unwound off of the running web material roll at a constant transverse position.

In some embodiments, the constant transverse position at which the web retaining assembly holds the running web is aligned with a transverse position of the waiting web of the new web material roll to which the running web is to be spliced, the waiting web having a web width equal to the web width of the running web.

In some embodiments, the turret unwind unit includes a frame, a turret arm rotatably mounted to the frame and rotatable about a center axis, a first rotatable shaft positioned at a first end of the turret arm, the first rotatable shaft configured to hold and selectively unwind the running web of the running web material roll, and a second rotatable shaft positioned at a second end of the turret arm, the second rotatable shaft configured to hold and selectively unwind the waiting web of the new web material roll.

In some embodiments, the web diverter unit includes a base, a mounting arm fixedly coupled to the base and extending out therefrom, the mounting arm having a first end coupled to the base and a second end coupled to the web retaining assembly, and an actuator positioned between the second end of the mounting arm and the web retaining assembly, the rotatable actuator operable to move the web retaining assembly relative to the mounting arm and between the first position and the second position.

In some embodiments, the base is coupled to the frame of the turret unwind unit, so as to remain fixed in place relative to rotation of the turret arm about the central axis.

In some embodiments, the actuator includes a rotary actuator operable to rotate the web retaining assembly between the first position and the second position.

In some embodiments, the web retaining assembly includes a pivot arm comprising a first end and a second end, with the first end of the pivot arm coupled to the actuator so as to move responsive to rotation of the rotary actuator and a diverter rod retained at the second end of the pivot arm so as to be oriented orthogonal to the pivot arm, with the diverter rod making contact with the running web when the web retaining assembly is in the second position.

In some embodiments, the actuator includes a linear actuator operable to linearly translate the web retaining assembly between the first position and the second position and the web retaining assembly comprises a diverter rod that is linearly translated by the linear actuator along a track plate coupled to the second end of the mounting arm.

In some embodiments, wherein the web diverter unit includes a web sensing device that detects the transverse position of the running web and a direction of transverse movement of the running web and as it unwinds from the running web material roll; and a controller operably connected to the web sensing device and programmed to cause the actuator to move the web retaining assembly from the first position to the second position upon the running web passing a pre-determined transverse position on the running web material roll, while moving in the transverse direction away from the turret arm.

In some embodiments, the controller is programmed to control the actuator to retain the web retaining assembly in the second position for a pre-determined period of time, during which the running web is spliced to the waiting web, before returning the web retaining assembly to the first position.

In some embodiments, the actuator includes an electromagnet actuator or a pneumatic actuator.

In accordance with other embodiments, a method for splicing web material rolls is provided. The method includes splicing a running web from a running web material roll with a waiting web of a new web material roll, each of the running web and the waiting web having a web width less than a roll width of the running web material roll and the new web material roll, respectively, and being transversely helically wound thereon. The method includes operating a turret unwind unit to unwind a running web from a running web material roll mounted on a first end of a turret arm of the turret unwind unit; monitoring, via a control system, an amount of running web remaining on the running web material roll; and upon the amount of running web remaining falling below a pre-determined amount, performing a splicing sequence to selectively splice the running web with a waiting web of a new web material roll mounted on a second end of the turret arm. Performing the splicing sequence includes moving a web retaining assembly of a web diverter unit from a first position to a second position, with the web retaining assembly contacting the running web being unwound off of the running web material roll when in the second position and temporarily holding the running web a constant transverse position along the running web material roll. The method further includes operating a web splicing unit selectively splice the running web of the running web material roll with the waiting web of the new web material roll while the running web is held at the constant transverse position.

In some embodiments, the method includes determining, via a control system comprising a controller and a web sensing device, a location and direction of travel of the running web in a transverse direction of the running web material roll; and controlling, via the controller, an actuator of the web diverter unit to move the web retaining assembly from the first position to the second position upon the running web passing a pre-determined transverse position on the running web material roll, while moving in the transverse direction away from the turret arm.

In some embodiments, the method includes retaining the web retaining assembly in the second position for a pre-determined period of time, during which the running web is spliced to the waiting web, before controlling the actuator to move the web retaining assembly back to the first position.

In some embodiments, the method includes one of rotating the web retaining assembly from the first position to the second position and linearly translating the web retaining assembly from the first position to the second position.

In some embodiments, the method includes moving the web retaining assembly relative to a mounting arm of the web diverter unit that is affixed to a frame of the turret unwind unit, such that the web diverter unit remains stationary relative to rotation of the turret arm when repositioning the running web material roll and new material roll upon performing of the splicing sequence.

These and other advantages and features will be more readily understood from the following detailed description of preferred embodiments of the disclosure that is provided in connection with the accompanying drawings.

BRIEF DESCRIPTION OF THE DRAWINGS

The drawings illustrate embodiments presently contemplated for carrying out the disclosure.

In the drawings.

DETAILED DESCRIPTION

Figure 1A:
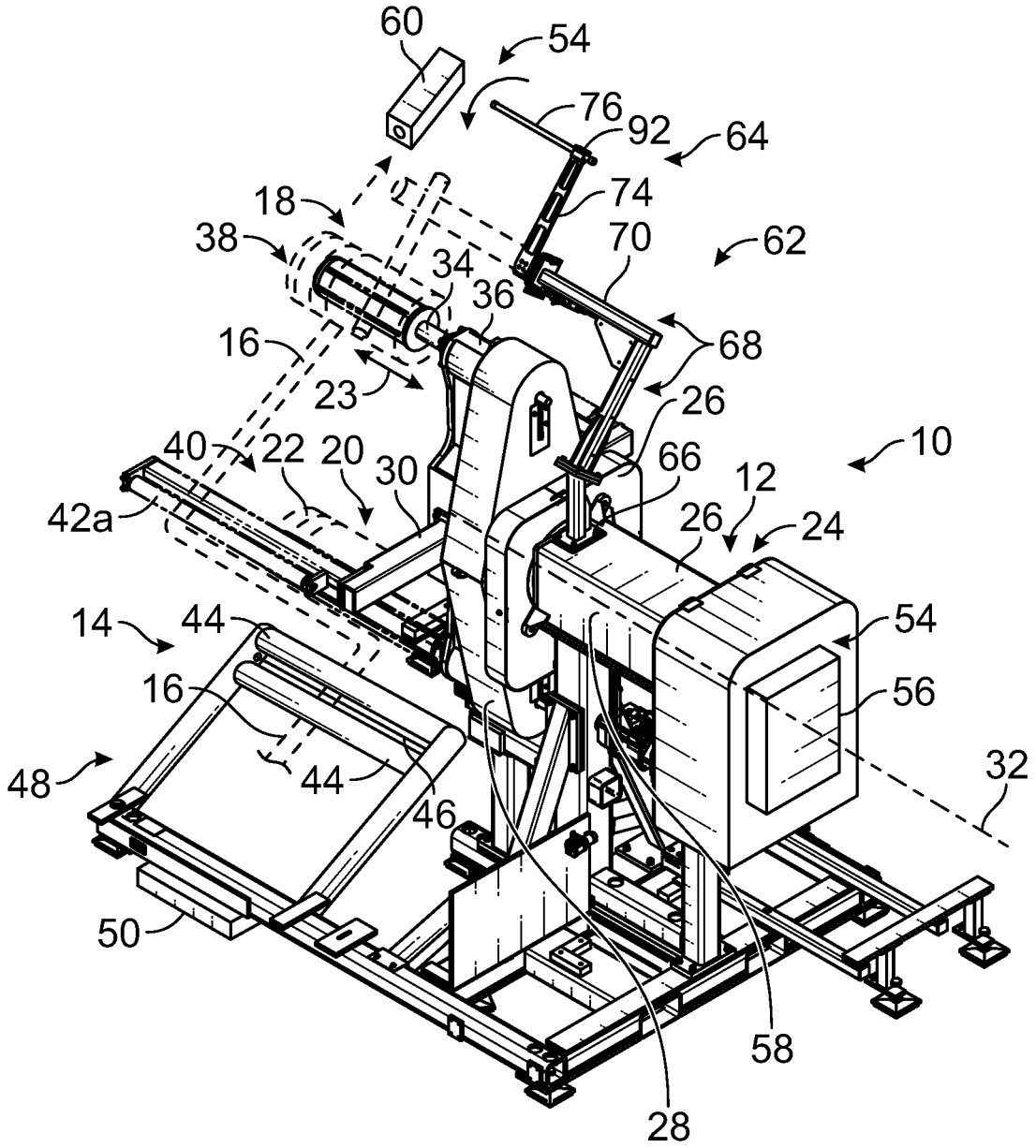
FIGS. 1A and 1B are perspective views of a web unwinding and splicing system, according to an embodiment of the disclosure.

Embodiments of the disclosure provide a system and method for the splicing of material rolls that provide the webs used in the manufacture of a disposable garment assembly or absorbent sanitary product. The system and method enable the splicing of a running web that is transversely wound on a running web material roll with a waiting web on a new web material roll and provides for precise alignment of the running web with the waiting web for splicing therebetween.

Referring first to FIG. 1, a web unwinding and splicing system 10 is illustrated according to an example embodiment. The system 10 includes a web unwinding unit 12 and a web splicing unit 14 that operate in conjunction to provide for the positioning and unwinding of a first or running web 16 from a running web material roll 18 and for the positioning of a second or new web material roll 20, from which a waiting web 22 may be spliced with the running web 16 as the running web material roll 18 nears expiration. At or near the expiration of the running web 16 of the running web material roll 18, the web 16 on the running web material roll 18 is spliced with the web 22 on the new web material roll 20—with the engagement of the web 22 on the new web material roll 20 occurring by splicing the web 16 being unwound from the running web material roll 18 thereto.

According to embodiments, the webs 16, 22 provided on the web material rolls 18, 20 may be any of a number of raw materials typically used in the manufacture of a disposable garment. The webs 16, 22 may therefore be provided as cellulose pulp, tissue paper, polypropylene, nonwoven web, perforated films, foam, and elastic, as non-limiting examples. Additionally, and as shown in FIG. 1, the webs 16, 22 wound on the respective web material rolls 18, 20 are narrow webs having a width that is less than the overall width of the material roll. The narrow webs 16, 22 are wound on the material rolls 18, 20 in a transverse fashion such that a position of the web along the transverse direction 23 of the material roll will vary as the web is unwound therefrom by the web unwinding unit 12.

As shown in FIG. 1, the web unwinding unit 12 is constructed as a turret unwind unit 24 that includes a main frame 26 and an arrangement of a turret arm 28 and a guide arm 30 that are rotatably coupled to the main frame 26 and that rotate about a central axis 32. The turret arm 28 includes a rotatable shaft or spindle 34 (each driven by a motor 36) on each of opposing ends thereof on which the web material rolls 18, 20 are held. In a preferred embodiment, the running web material roll 18 is positioned in an unwind position 38 at the top of turret arm 28 and the new web material roll 20 is positioned in a standby position 40 at the bottom of turret arm 28. The guide arm 30 is positioned and oriented so as to be substantially perpendicular to the turret arm 28. Guide rollers 42*a*, 42*b* are positioned on opposing ends of the guide arm 30, with the guide rollers 42*a*, 42*b* selectively receiving a web 16, 22 of material thereon during unwinding of the respective web material rolls 18, 20, i.e., the web 16 from web material roll 18 travels about the guide roller 42*a* when the web material roll 18 is in the unwind position 38 and the web 16 is unwound therefrom, while the web 22 from web material roll 20 travels about the guide roller 42*b* when the web material roll 20 is in the unwind position 38 and the web 22 is unwound therefrom.

The web splicing unit 14 is provided adjacent to the web unwinding unit 12 to provide for splicing of the running web 16 of web material roll 18 with the waiting web 22 of new web material roll 20. To provide for such splicing, the web splicing unit 14 includes an arrangement of rollers 44 and a cutting member 46 that are positioned on a movable arm structure 48 that may be actuated by one or more air cylinders or a drive unit 50. The rollers 44 are positioned and arranged to receive the running web 16 from the guide roller 42*a* of the turret unwind unit 24 and route the running web 16 such that it is brought into proximity with the new web material roll 20 before being routed away therefrom. In operation of the web splicing unit 14, the drive unit 50 operates to reposition the arm structure 48 to cause one of the rollers 44 about which the running web 16 is guided to deflect and bump into the new web material roll 20—hereafter "bump roller 44*a*." The deflection of the bump roller 44*a* into the new web material roll 20 causes the running web 16 to contact a splice tape 52 (FIG. 5) provided on the waiting web 22 of the new web material roll 20, with the running web 16 adhering to the splice tape 52 and causing the running web 16 to splice with the waiting web 22. In alternative embodiments, splice tape 52 may be replaced by other known coupling methods and materials (i.e. adhesive).

In the illustrated embodiment, the cutting member 46 of the web splicing unit 14 is provided as a blade or wire, as non-limiting examples, which is fixed to the arm structure 48. As the arm structure 48 is repositioned toward the new web material roll 20 by the drive unit 50, the cutting member 46 also moves toward the running web 16. As the cutting member 46 moves into contact with the running web 16, the cutting member 46 severs the web, separating the running web 16 into two sections—i.e., a leading portion that is spliced with the waiting web 22 of the new web material roll 20 and a trailing portion that remains on the expiring web material roll 18.

A control system 54 is provided in the web unwinding and splicing system 10 to control operation of the web unwinding unit 12 and the web splicing unit 14. The control system 54 includes a controller 56 that may selectively operate components of the web unwinding unit 12 and the web splicing unit 14. In operation of the web unwinding unit 12, the controller 56 may control operation of the motors 36 that drive rotation of the shafts 34 of the turret arm 28 and a motor 58 that drives rotation of the turret arm 28 to reposition the web material rolls 18, 20. In operation of the web splicing unit 14, the controller may control operation of the drive unit 50 to alter the positioning of the arm structure 48 (and rollers 44) relative to the new web material roll 20.

A web sensing device 60 is also included in the control system 54 that monitors an amount of web 16 remaining on the running web material roll 18. According to an embodiment, the web sensing device 60 may be configured as a camera or other vision system that acquires images to monitor an amount of web 16 remaining on the running web material roll 18. According to alternative embodiments, the web sensing device 60 may be configured as an optical sensor or proximity sensor that monitors an amount of web 16 remaining on the running web material roll 18. The web sensing device 60 provides inputs to the controller 56 that are processed by the controller 56 in order to determine when the running web material roll 18 is close to expiring, thus necessitating a splicing of the running web 16 of the running web material roll 18 with the waiting web 22 of the new web material roll 20. According to embodiments, the control system 54 may determine that a splicing of the running web 16 of the running web material roll 18 with the waiting web 22 of the new web material roll 20 is necessary when less than a pre-determined amount of running web 16 is left on the running web material roll 18. For example, the control system may determine that splicing is desired when less than 5% or less than 1%) of the starting amount of the running web 16 is left on the running web material roll 18.

In an initial operation of the system, the web unwinding unit 12 provides for the running web material roll 18 in the unwind position 38 to be unwound, where the unwound running web 16 travels substantially about a circumference of the guide roller 42*a* and toward the web splicing unit 14. When the web sensing device 60 detects that the web 16 of running web material roll 18 in the top, unwind position 38 on turret unwind unit 24 is set to expire, a splice sequence is initiated between the running web material roll 18 and the waiting web 22 of the new web material roll 20. As part of the splicing sequence, the arm structure 48 of the web splicing unit 14 is caused to move further toward the web unwinding unit 12 to cause the bump roller 44*a* to deflect or bump the running web 16 into the waiting web 22, such that the running web 16 is spliced with the waiting web 22 on the new web material roll 20.

As previously described, the webs 16, 22 wound on the respective web material rolls 18, 20 are narrow webs having a width that is less than the overall width of the material roll. The webs 16, 22 are thus wound on the material rolls 18, 20 in a transverse fashion and, accordingly, a transverse position of the web 16, 22 along the material roll 18, 20 varies as the web is unwound therefrom by the web unwinding unit 12.

In order to account for the changing transverse position of the running web 16 during unwinding and enable a more accurate and consistent splicing between the running web 16 and the waiting web 22, a web diverter unit 62 is included in the system 10. The web diverter unit 62 is operable to selectively contact the running web 16 as it is unwound from the running web material roll 18 and temporarily retain the web 16 at a fixed transverse location in order to provide for precise alignment and splicing of the running web 16 with the waiting web 22.

Figure 1B:
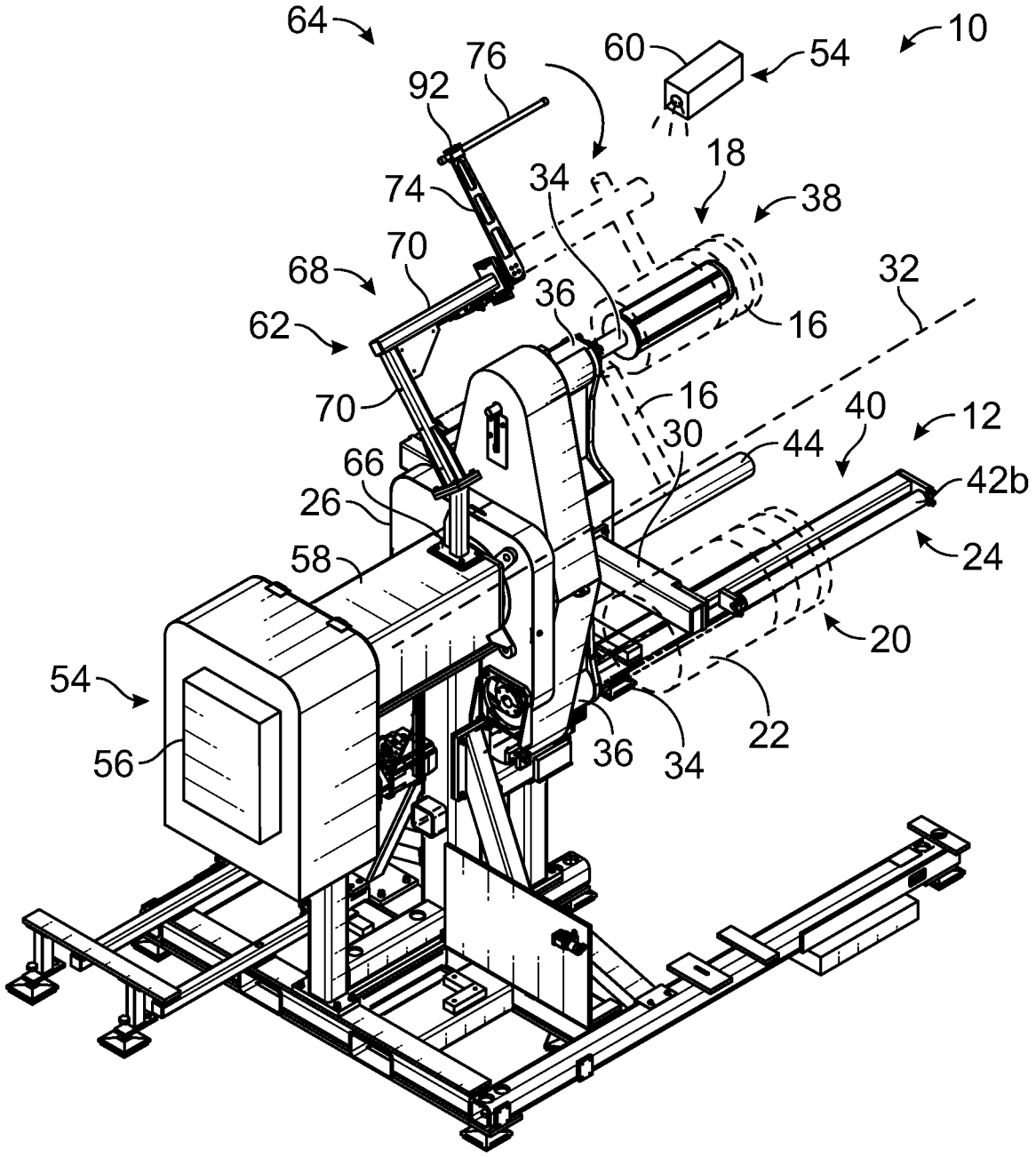
Figure 2:
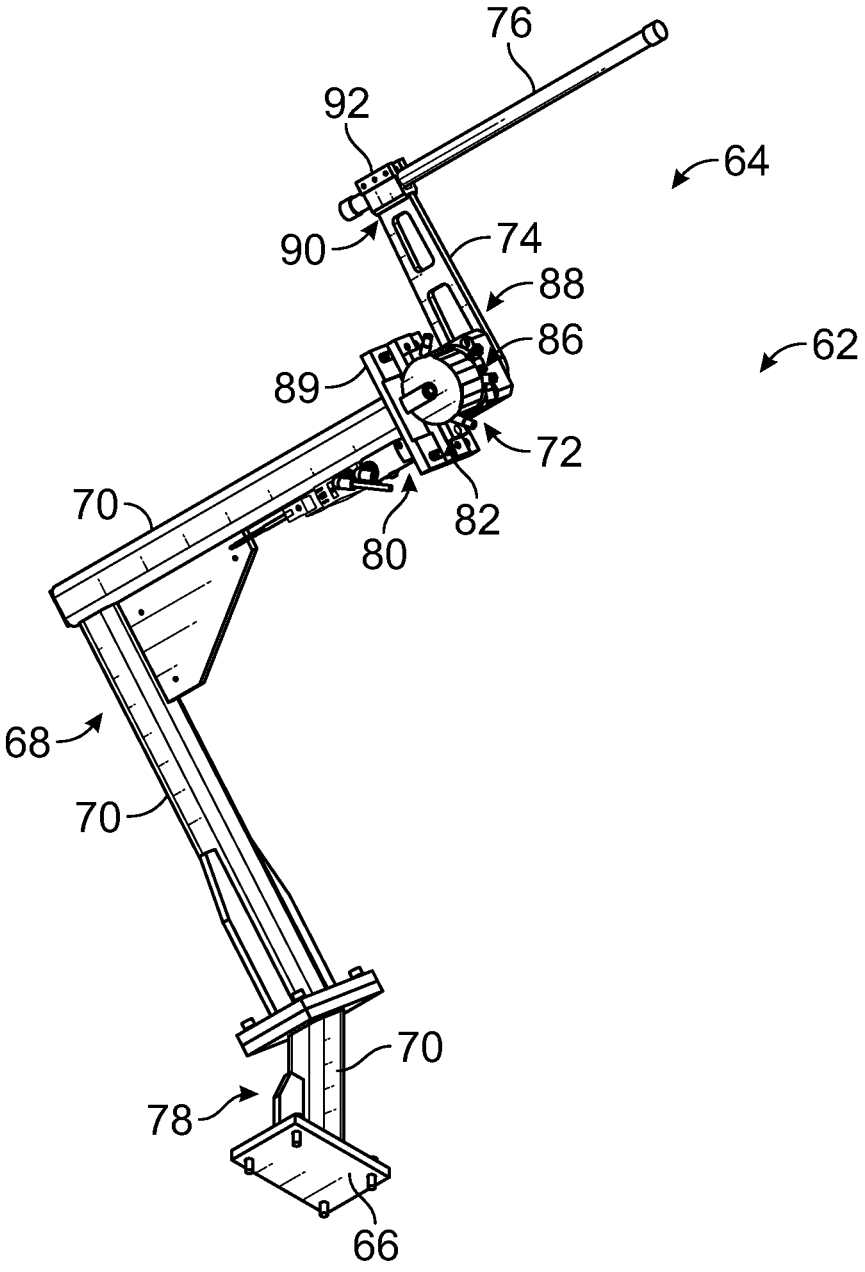
FIG. 2 is a perspective view of a web diverter unit included in the system of FIGS. 1A and 1B, according to an embodiment of the disclosure.

As shown in FIGS. 1A and 1B and now also in FIG. 2, the web diverter unit 62 includes a web retaining assembly 64 whose positioning is controllable via an associated control system (such as control system 54) to selectively position the web retaining assembly 64 relative to the running web material roll 18. In an example embodiment, the web diverter unit 62 includes a base 66, a mounting arm 68 (composed of arm segments 70), an actuator 72, and the web retaining assembly 64—with the web retaining assembly 64 including a pivot arm 74 and diverter rod 76. The base 66 mounts and retains the web diverter unit 62 at a position relative to the web unwinding unit 12. In the illustrated embodiment, the base 66 mounts the web diverter unit 62 to the frame 26 of the web unwinding unit 12, but it is recognized that the base 66 could instead be secured to another ground structure or directly to the turret arm 28 in other embodiments—with it recognized that mounting to the turret arm 28 would necessitate inclusion of a separate web diverter 62 for each turret arm 28. The mounting arm 68 is coupled to the base 66 in a fixed fashion and extends vertically upward therefrom, such that a first end 78 of the mounting arm 68 is fastened to the base 66 and a second end 80 of the mounting arm 68 is distal from the first end 78 at a position above the turret unwind unit 24. While the mounting arm 68 is shown in FIGS. 1 and 2 as being composed of numerous arm segments 70, it is recognized that the mounting arm 68 could instead be composed of a single segment.

The pivot arm 74 is positioned adjacent the second end 80 of the mounting arm 68 and is coupled thereto via the actuator 72, so as to be movable relative to the mounting arm 68. In the example embodiment, the actuator 72 is configured as a rotary actuator (hereafter "rotary actuator 72") that functions to pivot or rotate the pivot arm 74 relative to the mounting arm 68. The rotary actuator 72 may be constructed as an electromagnetic actuator or a pneumatic actuator that, according to embodiments, provides a quick and accurate response to commands received thereby. A stationary mount 82 of the rotary actuator 72 may be coupled to a swivel mount 84 provided at the second end 80 of the mounting arm 68, with a rotating component 86 of the rotary actuator 72 coupled to a first end 88 of the pivot arm 74.

As shown best in FIG. 2, the diverter rod 76 is retained at a second end 90 of the pivot arm 74, such as by a clamp 92 provided on the pivot arm 74, so as to be oriented generally perpendicular to the pivot arm 74. The diverter rod 76 may be retained by the clamp 92 adjacent to one end of the diverter rod 76 so that the diverter rod 76 extends out orthogonal to the pivot arm 74 by almost a full length of the diverter rod 76. The diverter rod 76 may be constructed as a tube-type structure composed of a carbon fiber or other lightweight material that minimizes the weight of the diverter rod 76, thereby lowering the amount of force required by the rotary actuator 72 to rotate the diverter rod 76 (in conjunction with the pivot arm 74).

The rotary actuator 72 is operable to rotate the pivot arm 74 and diverter rod 76 between a first position (i.e., raised position) and a second position (i.e., lowered position), as illustrated in FIGS. 1A and 1B. With the rotary actuator 72 operating to position the pivot arm 74 and diverter rod 76 in the first position, the diverter rod 76 is raised up such that it is clear of the operation of the turret unwind unit 24 and does not come into contact with the running web 16 as it is being unwound from the running web material roll 18. The raised position may be considered a default position, as the diverter rod 76 will be in the raised position when the running web 16 is being unwound from the running web material roll 18 during normal operation of the system 10. With the rotary actuator 72 operating to position the pivot arm 74 and diverter rod 76 in the second position, the diverter rod 76 is lowered such that it contacts the running web 16 as it is being unwound from the running web material roll 18. The lowered position may be considered a splicing position, as the diverter rod 76 will be in the lowered position when the running web 16 is being unwound from the running web material roll 18 and is to be spliced with the waiting web 22 of the new web material roll 20. When in the lowered position, the diverter rod 76 makes contact with the running web 16 and retains the web at a pre-determined, constant transverse location as it unwinds from the running web material roll 18. The retaining of the running web 16 at this pre-determined, constant transverse location provides for an accurate splicing of the running web 16 with the waiting web 22, as chances for a misalignment of the running web 16 and the waiting web 22 may be minimized with the running web 16 being retained at a constant transverse location during splicing.

As previously indicated, a control system is provided in the web diverter unit 62 to control positioning of the web retaining assembly 64 relative to the running web material roll 18. In the present embodiment, the control system that controls operation of the web diverter unit 62 (i.e., controls operation of rotary actuator 72) is the control system 54 that also controls operation of the web splicing unit 14 and the web unwinding unit 12. Thus, the controller 56 and web sensing device 60 of the control system 54 may operate to control operation of the web diverter unit 62 as part of an overall control scheme for the system 10. In other embodiments, a stand-alone controller and/or web sensing device may form a control system for the web diverter unit 62 to provide for dedicated control of the actuator 72, with the stand-alone controller being in operative communication with another controller or controllers (e.g., controller 56) that operate the turret unwind unit 24 and web splicing unit 14.

Regarding the web sensing device 60, the web sensing device 60 may be provided as a camera, vision system, or optical sensor, according to embodiments, with the web sensing device 60 providing inputs to the controller 56 that are processed by the controller 56 in order to determine when the rotary actuator 72 is to be operated to provide for rotation of the pivot arm 74 and diverter rod 76. The web sensing device 60 operates to identify a position of the running web 16 in the transverse direction 23 as it is unwound from the running web material roll 18. That is, due to the transverse winding of the running web 16 on the running web material roll 18, the transverse position of the web 16 changes as it is unwound from the running web material roll 18. The web sensing device 60 operates to identify a position of the running web 16 in the transverse direction 23 and also to identify the direction in which the running web 16 is moving as it unwinds, i.e., toward or away from the turret arm 28 in the transverse direction 23.

In operation of the web diverter unit 62, the control system 54 operates to identify when a splicing of the running web 16 to the waiting web 22 is desired, with such an identification being based on a monitoring of the remaining amount of web 16 on the running web material roll 18 (via web sensing device 60) and a determination (by controller 56) that the running web 16 will soon be completely unwound from the running web material roll 18. Upon such an identification, the controller 56 analyzes further inputs from the web sensing device 60 regarding the transverse position of the running web 16 on the running web material roll 18 and the transverse direction in which the running web 16 is moving.

If it is determined by the web sensing device 60 that the transverse position of the running web 16 is moving in a direction away from the turret arm 28 as it is being unwound, and that the running web 16 has passed a pre-determined transverse location along the running web material roll 18 (e.g., the mid-point of the running web material roll 18 in the transverse direction), the controller 56 commands the rotary actuator 72 to rotate the pivot arm 74 and diverter rod 76 from the first position to the second position. The diverter rod 76 is thus caused to pivot from a raised position, where it is not in contact with the running web 16, to a lowered position where it comes into contact with the running web 16 as it is being unwound from the running web material roll 18. With the diverter rod 76 pivoted to the lowered position, the diverter rod 76 will make contact with the running web 16 upon the web moving back toward the turret arm 28 in the transverse direction to the location at which the diverter rod 76 is positioned. The diverter rod 76 then retains the running web 16 at this pre-determined, constant transverse location as it unwinds from the running web material roll 18—with the running web 16 being retained at this transverse location until the running web 16 has been spliced with the waiting web 22. In one embodiment, the diverter rod 76 is maintained at the lowered position for a pre-determined period of time (stored in controller 56) that is long enough for the splicing operation to be performed. Upon completion of the pre-determined period of time, the controller 56 then commands the rotary actuator 72 to rotate the pivot arm 74 and diverter rod 76 from the second position back to the first position. With the pivot arm 74 and diverter rod 76 pivoted back to the first position, clearance is provided for the turret unwind unit 24 to reposition the web material rolls 18, 20—with the new web material roll 20 being rotated to the unwind position 38 and the expiring, running web material roll 18 being rotated to the standby position 40. The angle of contact between the diverter rod 76 and the running web 16 and/or the shape of the diverter rod 76 itself may be adjusted from that depicted in the figures to maintain desired control of the web material and mitigate edge roll, necking, and other undesirable material response to being temporarily retained by the diverter rod 76.

Figure 3:
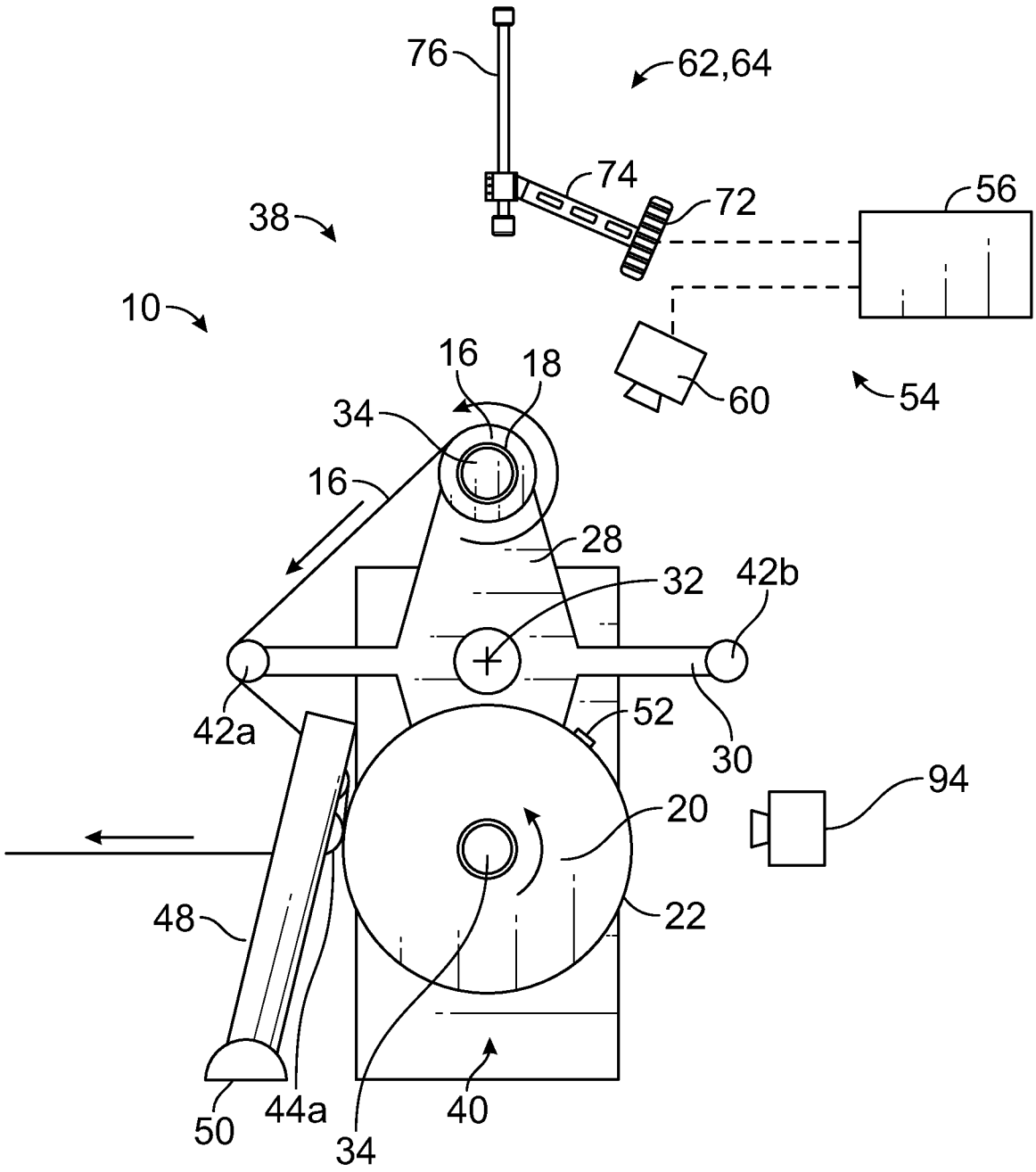
FIGS. 3-8 are views of a splicing sequence implemented by the system of FIGS. 1A and 1B, according to an embodiment of the disclosure.
Figure 4:
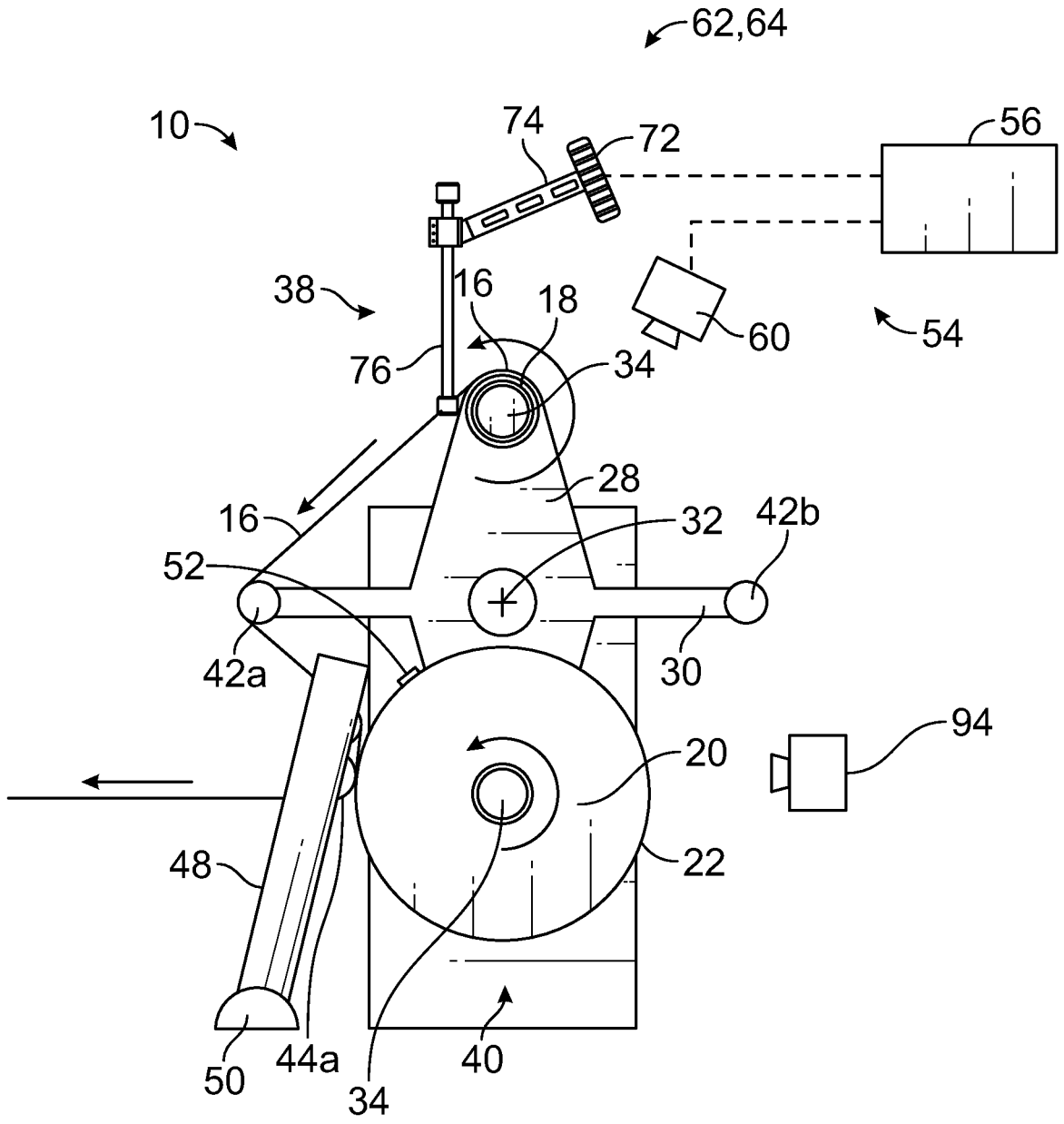

Referring now to FIGS. 3-8, a splicing sequence is shown that may be implemented by the web unwinding and splicing system 10 when the system detects that a running web material roll 18 in the unwind position 38 is set to expire of web material 16. Referring first to FIGS. 3 and 4, when the web sensing device 60 detects that the running web material roll 18 is coming close to expiration, as can be seen by comparison of FIG. 3 to FIG. 4, the controller 56 operates to prepare for an impending splicing operation to be performed. Accordingly, the controller 56 causes the rotational speed of the new web material roll 20 to increase (via control of the motor 36 of shaft 34) and match the speed of the running web material roll 18. Additionally, the controller 56 analyzes inputs from the web sensing device 60 regarding the transverse positioning of the running web 16 on the running web material roll 18. Upon a determination by the controller 56 that the running web 16 is moving in a transverse direction away from the turret arm 28 as it is being unwound, and that the running web 16 has passed a pre-determined transverse location along the running web material roll 18 (e.g., the mid-point of the running web material roll 18 in the transverse direction 23), the controller 56 commands the rotary actuator 72 of the web diverter unit 62 to rotate the pivot arm 74 and diverter rod 76 from a raised position to a lower position, as shown in FIG. 4.

Figure 5:
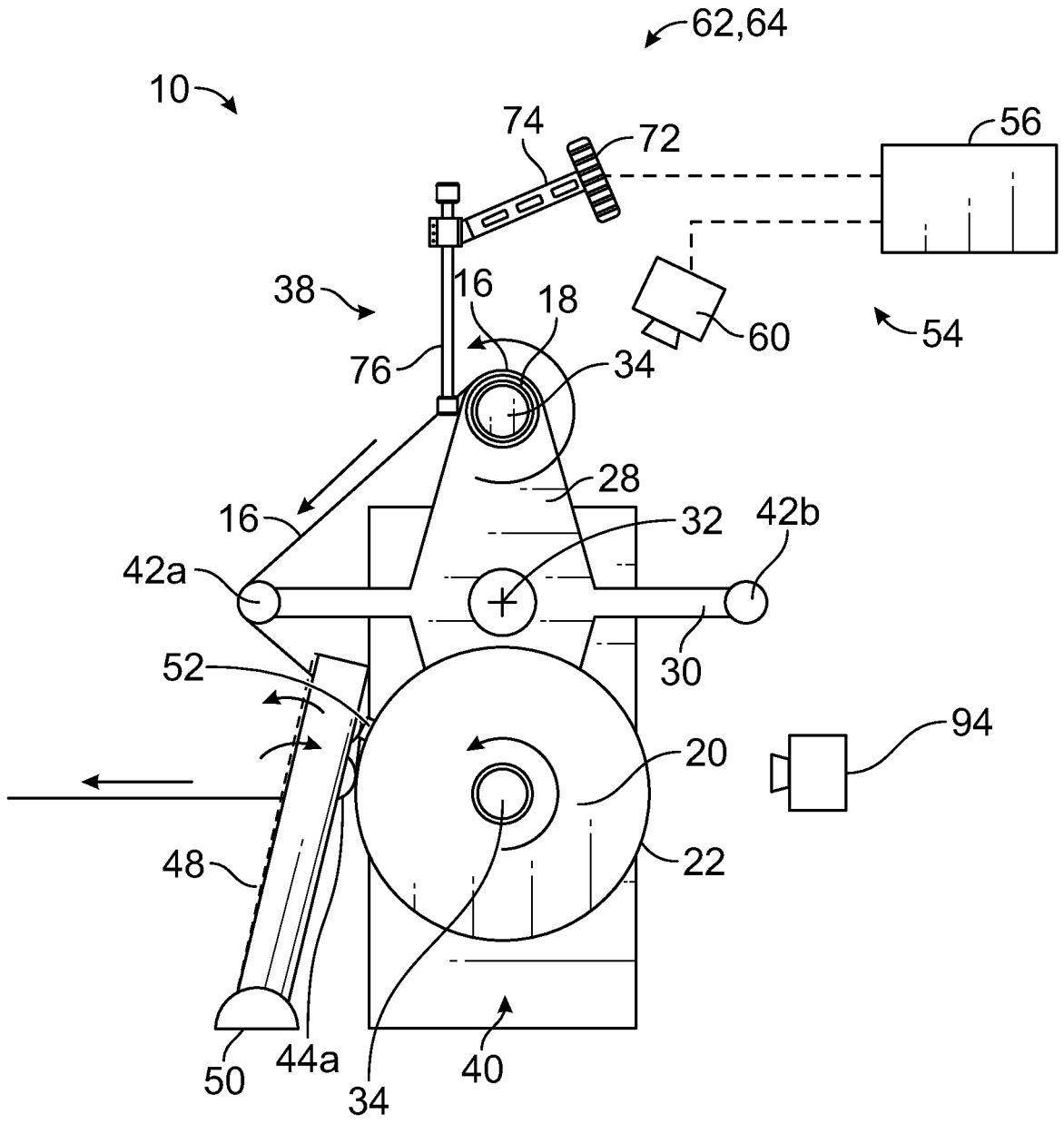
Figure 6:
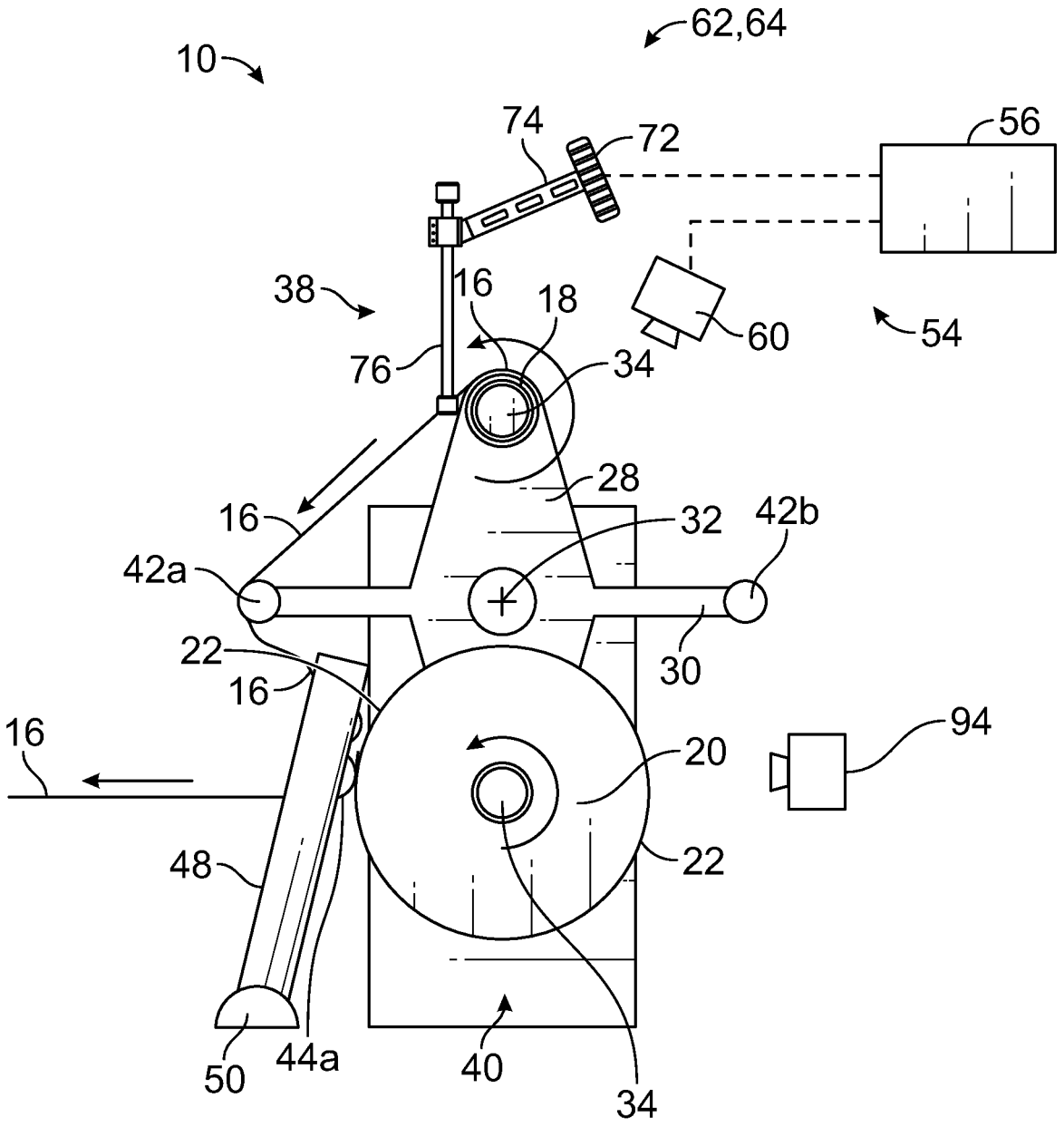

Referring now to FIGS. 5 and 6, the diverter rod 76 of web diverter unit 62 is now engaged with the running web 16 and holding the web at a constant transverse location along the running web material roll 18. With the running web 16 being held in position, the arm structure 48 of the web splicing unit 14 is actuated (by drive unit 50) to move the bump roller 44*a* in toward the new web material roll 20, bringing the running web 16 into contact with the waiting web 22, as shown in FIG. 5. In controlling the timing of the bumping of the running web 16 into contact with the waiting web 22, a separate vision system 94 identifies the location of a splice tape 52 on the waiting web 22, and then the new web material roll 20 is driven by its rotational shaft 34 so that, at the moment of splice, a bump of the running web 16 towards the splice tape 52 by bump roller 44*a* bonds the web 16 of the running web material roll 18 to the web 22 of the new web material roll 20 via the splice tape 52. At the same time as the bump, the cutting member 46 severs the running web 16. In this manner, the running web 16 of the expiring web material roll 18 is spliced to the leading edge of the waiting web 22 on the new web roll material 20, as depicted in FIG. 6.

Figure 7:
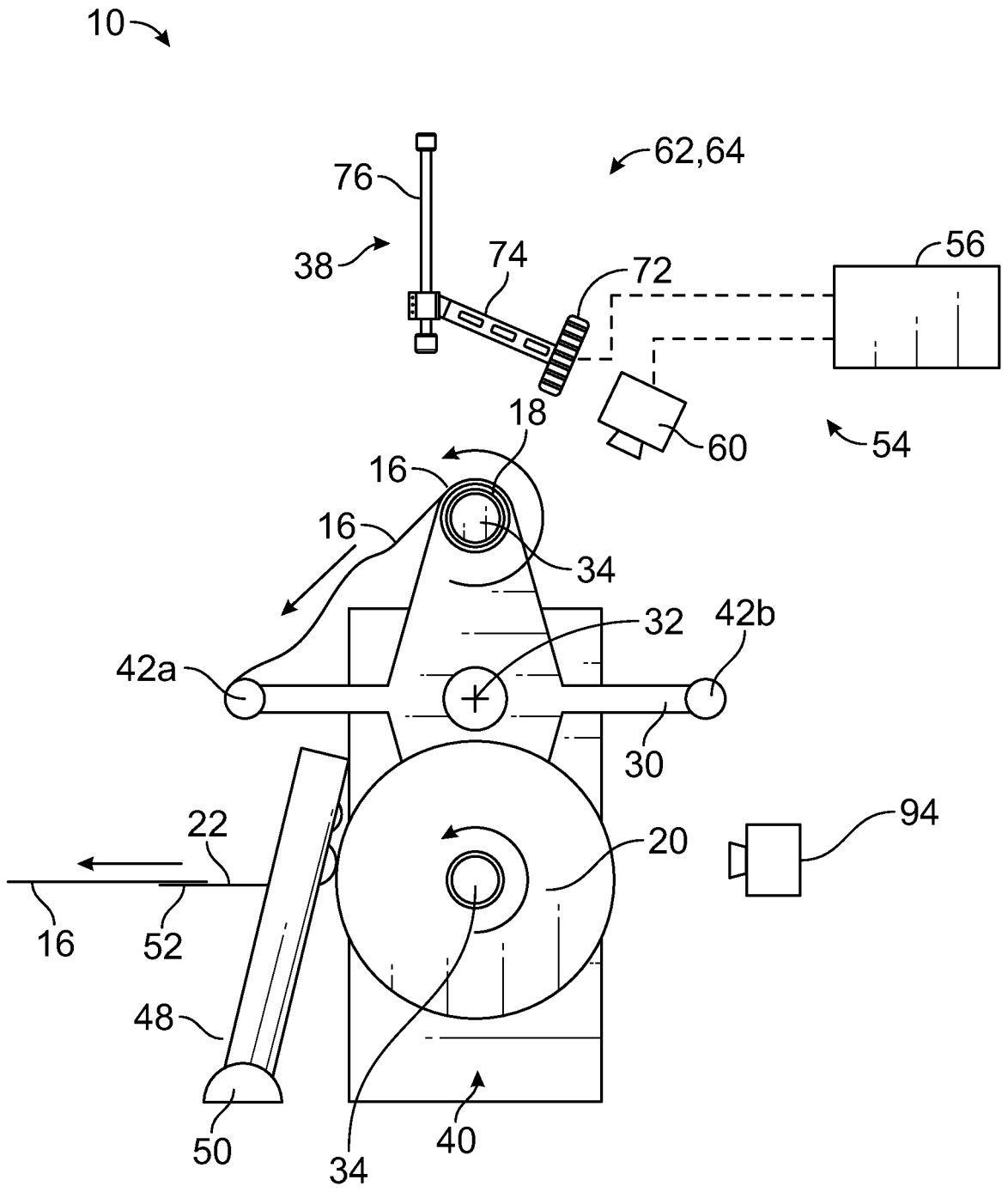

Referring now to FIG. 7, simultaneous with (or shortly after) the running web 16 being spliced with the waiting web 22 and the running web 16 being severed, the controller 56 commands the rotary actuator 72 of the web diverter unit 62 to rotate the pivot arm 74 and diverter rod 76 from the lowered position back to the raised position.

Figure 8:
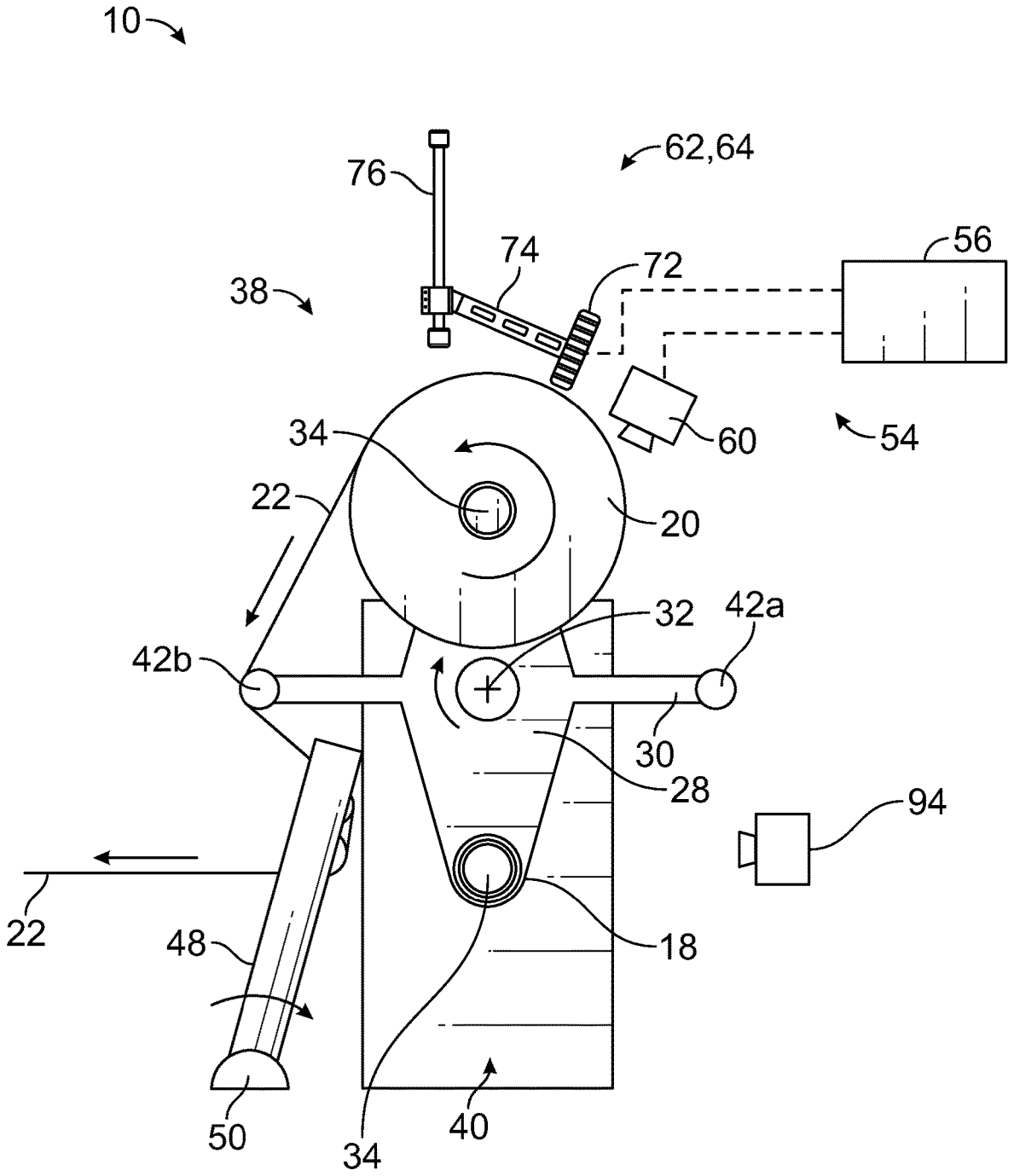

Next referring to FIG. 8, the turret arm 28 then rotates to place the new material roll 20 into the unwind position 38

(because the new web material roll 20 will now be the running web material roll), preferably at the top vertical position of the turret arm 28. Rotation of the turret arm 28 also places the now expired (or nearly expired) web material roll 18 in the standby position 40, where the web material roll 18 may be removed/discarded and another new web material roll loaded onto the shaft 34. Unwinding of the web 22 from the material roll 20 then continues similar to the unwinding of the running web 16 from the material roll 18, as previously described.

Figure 9:
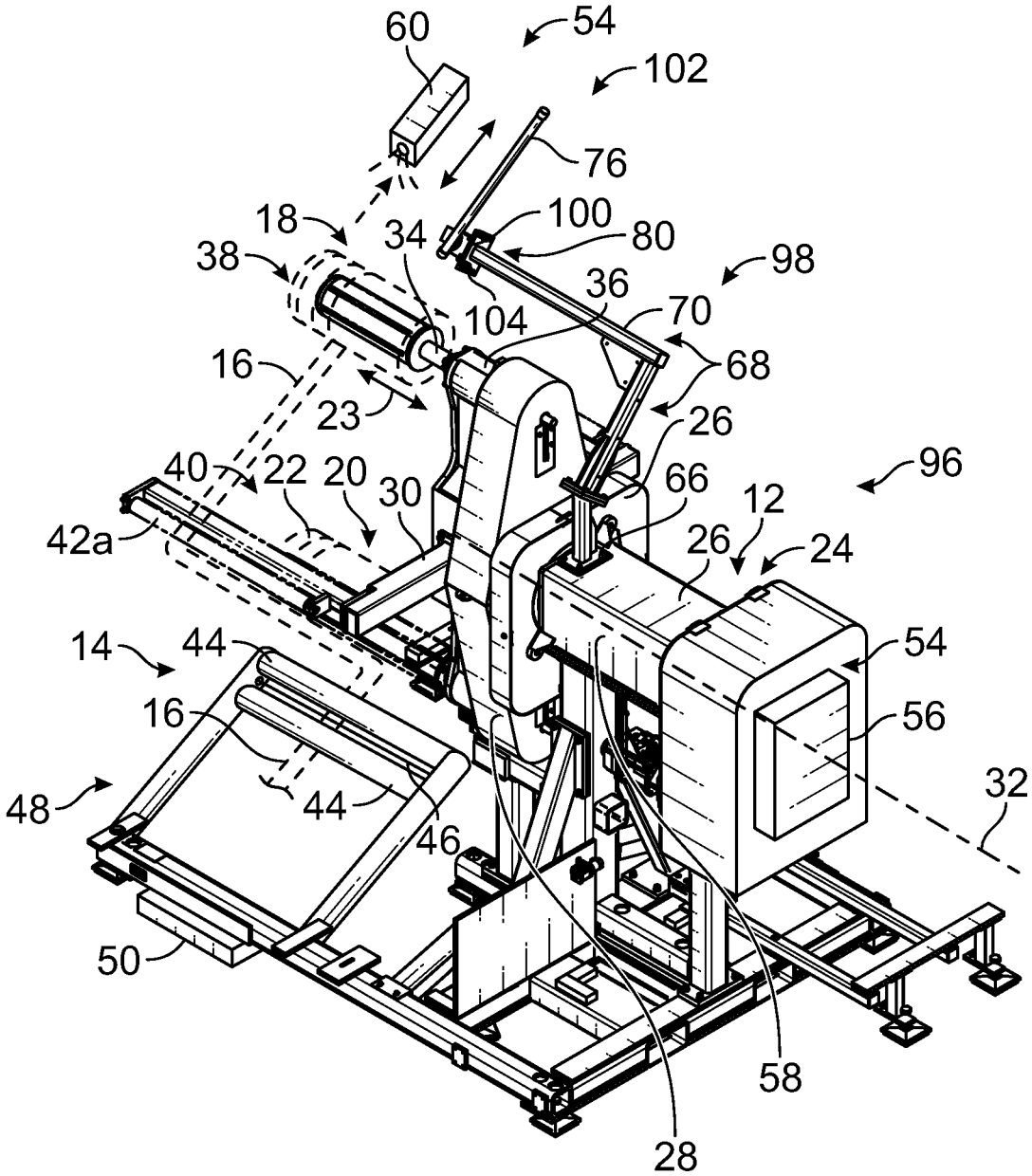
FIG. 9 is a perspective view of a web unwinding and splicing system, with a diverter rod thereof in a retracted position, according to another embodiment of the disclosure.
Figure 10:
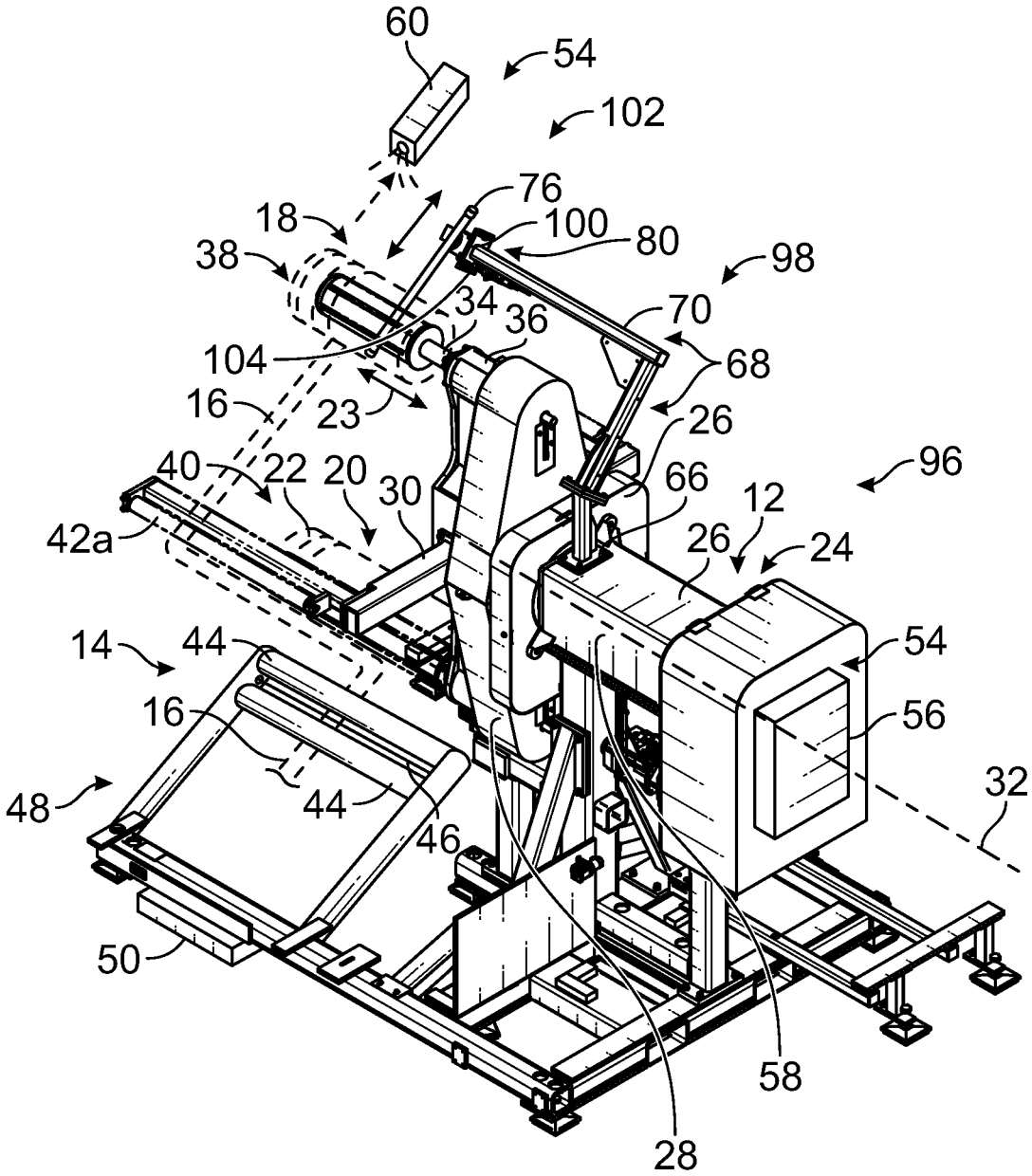
FIG. 10 is a perspective view of the web unwinding and splicing system of FIG. 9, with the diverter rod thereof in an extended position.

Referring now to FIGS. 9 and 10, a web unwinding and splicing system 96 is illustrated according to another embodiment. The system 96 shares many common components with the system 10 of FIGS. 1-3, and thus like components in system 96 are numbered identically to those in system 10. However, distinct from the system 10, a web diverter unit 98 included in the system 96 includes a linear actuator 100 that provides linear movement of the diverter rod 76 therein as compared to a rotational movement.

As shown in FIGS. 9 and 10, the web diverter unit 98 of the system 96 includes a base 66, a mounting arm 68 (composed of arm segments 70), a linear actuator 100, and a web retaining assembly 102—with the web retaining assembly including the diverter rod 76. The base 66 of the web retaining assembly 64 mounts and retains the web diverter unit 98 at a position relative to the web unwinding unit 12. In the illustrated embodiment, the base 66 mounts the web diverter unit 98 to the frame 26 of the web unwinding unit 12, but it is recognized that the base 66 could instead be secured to another structure (e.g., ground or the turret arm 28) in other embodiments. The mounting arm 68 is coupled to the base 66 in a fixed fashion and extends vertically upward therefrom, such that a first end 78 of the mounting arm 68 is fastened to the base 66 and a second end 80 of the mounting arm 68 is distal from the first end 78 and positioned above the turret unwind unit 24.

The diverter rod 76 is positioned adjacent the second end 80 of the mounting arm 68 and is coupled thereto via the linear actuator 100 so as to be movable relative thereto. The linear actuator 100 may be constructed as an electromagnetic actuator or a pneumatic actuator that, according to embodiments, provides a quick and accurate response to commands received thereby. The linear actuator 100 provides for translation of the diverter rod 76 along a track plate 104 that is positioned at the second end 80 of the mounting arm 68. Movement of the diverter rod 76 along the track plate 104 is in a direction toward or away from the running web material roll 18 in the unwind position 38 on the turret arm 28.

As shown in FIGS. 9 and 10, the diverter rod 76 is oriented generally perpendicular to the segment 70 of mounting arm 68 to which it is coupled (via actuator 100 and plate 104). The linear actuator 100 is operable to translate the diverter rod 76 between a first position (i.e., retracted position) and a second position (i.e., extended position). With the linear actuator 100 operating to position the diverter rod 76 in the first position, as seen in FIG. 9, the diverter rod 76 is retracted back away from the running web material roll 18 such that it is clear of the operation of the turret unwind unit 24 and does not come into contact with the running web 16 as it is being unwound from the running web material roll 18. The retracted position may be considered a default position, as the diverter rod 76 will be in the retracted position when the running web 16 is being unwound from the running web material roll 18 during normal operation of the system 96. With the linear actuator 100 operating to position the diverter rod 76 in the second position, as seen in FIG. 10, the diverter rod 76 is extended toward the running web material roll 18 such that it contacts the running web 16 as it is being unwound. The extended position may be considered a splicing position, as the diverter rod 76 will be in the extended position when the running web 16 is being unwound from the running web material roll 18 and is to be spliced with the waiting web 22 of the new material roll. When in the extended position, the diverter rod 76 makes contact with the running web 16 and retains the web at a pre-determined, constant transverse location as it unwinds from the running web material roll 18. The retaining of the running web 16 at this pre-determined, constant transverse location provides for an accurate splicing of the running web 16 with the waiting web 22, as chances for a misalignment of the running web 16 and the waiting web 22 may be minimized with the running web 16 being retained at a constant transverse location during splicing. The embodiment of FIGS. 9 and 10 depict the linear actuator 100 mounted perpendicular to axis 32. In an alternative embodiment, the linear actuator 100 may be mounted parallel to axis 32.

Beneficially, embodiments of the disclosure thus provide a system and method for the splicing of material rolls that provide the webs used in the manufacture of a disposable garment assembly or absorbent sanitary product. The system and method enable the splicing of a running web that is transversely wound on a running material roll with a waiting web on a new material and provides for precise alignment of the running web with the waiting web for splicing therebetween. A web diverter unit in the system operates to retain a running web at a constant transverse location during the splicing of the material webs, so as to eliminate the potential for misalignment between the running web and the waiting web and thereby provide for an accurate splicing of the running web with the waiting web.

Therefore, according to one embodiment of the disclosure, a web unwinding and splicing system includes a turret unwind unit configured to hold a running web material roll and a new web material roll and to unwind a running web from the running web material roll, the running web having a web width less than a roll width of the running web material roll and being wound onto the running web material roll such that a transverse position of the running web on the running web material roll varies as the running web is unwound therefrom. The system also includes a web splicing unit operable with the turret unwind unit to selectively splice the running web of the running web material roll with a waiting web of the new web material roll. The system further includes a web diverter unit having a web retaining assembly movable between a first position where the web retaining assembly is not in contact with the running web and a second position where the web retaining assembly is in contact with the running web. With the web retaining assembly in the second position, the web retaining assembly temporarily holds the running web being unwound off of the running web material roll at a constant transverse position.

According to another embodiment of the disclosure, a method is provided of splicing a running web from a running web material roll with a waiting web of a new web material roll, each of the running web and the waiting web having a web width less than a roll width of the running web material roll and the new web material roll, respectively, and being transversely helically wound thereon. The method includes operating a turret unwind unit to unwind a running web from a running web material roll mounted on a first end of a turret arm of the turret unwind unit; monitoring, via a control system, an amount of running web remaining on the running web material roll; and upon the amount of running web remaining falling below a pre-determined amount, performing a splicing sequence to selectively splice the running web with a waiting web of a new web material roll mounted on a second end of the turret arm. Performing the splicing sequence includes moving a web retaining assembly of a web diverter unit from a first position to a second position, with the web retaining assembly contacting the running web being unwound off of the running web material roll when in the second position and temporarily holding the running web a constant transverse position along the running web material roll. The method further includes operating a web splicing unit selectively splice the running web of the running web material roll with the waiting web of the new web material roll while the running web is held at the constant transverse position.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A web unwinding and splicing system comprising:

a turret unwind unit configured to hold a running web material roll and a new web material roll and to unwind a running web from the running web material roll, the running web having a web width less than a roll width of the running web material roll and being wound onto the running web material roll such that a transverse position of the running web on the running web material roll varies as the running web is unwound therefrom;

a web splicing unit operable with the turret unwind unit to selectively splice the running web of the running web material roll with a waiting web of the new web material roll; and a web diverter unit including a web retaining assembly movable between a first position where the web retaining assembly is not in contact with the running web and a second position where the web retaining assembly is in contact with the running web;

wherein, with the web retaining assembly in the second position, the web retaining assembly temporarily holds the running web being unwound off of the running web material roll at a constant transverse position.

2. A system according to claim 1, wherein the constant transverse position at which the web retaining assembly holds the running web is aligned with a transverse position of the waiting web of the new web material roll to which the running web is to be spliced, the waiting web having a web width equal to the web width of the running web.

3. A system according to claim 1, where the turret unwind unit comprises:

a frame;

a turret arm rotatably mounted to the frame and rotatable about a center axis;

a first rotatable shaft positioned at a first end of the turret arm, the first rotatable shaft configured to hold and selectively unwind the running web of the running web material roll; and a second rotatable shaft positioned at a second end of the turret arm, the second rotatable shaft configured to hold and selectively unwind the waiting web of the new web material roll.

4. A system according to claim 3, wherein the web diverter unit further comprises:

a base;

a mounting arm fixedly coupled to the base and extending out therefrom, the mounting arm having a first end coupled to the base and a second end coupled to the web retaining assembly; and an actuator positioned between the second end of the mounting arm and the web retaining assembly, the rotatable actuator operable to move the web retaining assembly relative to the mounting arm and between the first position and the second position.

5. A system according to claim 4, wherein the base is coupled to the frame of the turret unwind unit, so as to remain fixed in place relative to rotation of the turret arm about the central axis.

6. A system according to claim 4, wherein the actuator comprises a rotary actuator operable to rotate the web retaining assembly between the first position and the second position; and wherein the web retaining assembly comprises:

a pivot arm comprising a first end and a second end, with the first end of the pivot arm coupled to the actuator so as to move responsive to rotation of the rotary actuator; and a diverter rod retained at the second end of the pivot arm so as to be oriented orthogonal to the pivot arm, with the diverter rod making contact with the running web when the web retaining assembly is in the second position.

7. A system according to claim 4, wherein the actuator comprises a linear actuator operable to linearly translate the web retaining assembly between the first position and the second position; and wherein the web retaining assembly comprises a diverter rod that is linearly translated by the linear actuator along a track plate coupled to the second end of the mounting arm.

8. A system according to claim 4, wherein the web diverter unit comprises:

a web sensing device that detects the transverse position of the running web and a direction of transverse movement of the running web and as it unwinds from the running web material roll; and a controller operably connected to the web sensing device and programmed to cause the actuator to move the web retaining assembly from the first position to the second position upon the running web passing a pre-determined transverse position on the running web material roll, while moving in the transverse direction away from the turret arm.

9. A system according to claim 8, wherein the controller is programmed to control the actuator to retain the web retaining assembly in the second position for a pre-determined period of time, during which the running web is spliced to the waiting web, before returning the web retaining assembly to the first position.

10. A system according to claim 4, wherein the actuator comprises one of an electromagnet actuator and a pneumatic actuator.

11. A method of splicing a running web from a running web material roll with a waiting web of a new web material roll, each of the running web and the waiting web having a web width less than a roll width of the running web material roll and the new web material roll, respectively, and being transversely wound thereon, the method comprising:

operating a turret unwind unit to unwind a running web from a running web material roll mounted on a first end of a turret arm of the turret unwind unit such that a transverse position of the running web on the running web material roll varies as the running web is unwound therefrom;

monitoring an amount of running web remaining on the running web material roll; and upon the amount of running web remaining falling below a pre-determined amount, performing a splicing sequence to selectively splice the running web with a waiting web of a new web material roll mounted on a second end of the turret arm, wherein performing the splicing sequence comprises:

moving a web retaining assembly of a web diverter unit from a first position to a second position, with the web retaining assembly contacting the running web being unwound off of the running web material roll when in the second position and temporarily holding the running web a constant transverse position along the running web material roll; and operating a web splicing unit to selectively splice the running web of the running web material roll with the waiting web of the new web material roll while the running web is held at the constant transverse position.

12. A method according to claim 11, wherein repositioning the web retaining assembly comprises:

determining, via a control system comprising a controller and a web sensing device, a location and direction of travel of the running web in a transverse direction of the running web material roll; and controlling, via the controller, an actuator of the web diverter unit to move the web retaining assembly from the first position to the second position upon the running web passing a pre-determined transverse position on the running web material roll, while moving in the transverse direction away from the turret arm.

13. A method according to claim 12, further comprising retaining the web retaining assembly in the second position for a pre-determined period of time, during which the running web is spliced to the waiting web, before controlling the actuator to move the web retaining assembly back to the first position.

14. A method according to claim 11, wherein moving the web retaining assembly comprises one of rotating the web retaining assembly from the first position to the second position and linearly translating the web retaining assembly from the first position to the second position.

15. A method according to claim 11, wherein moving the web retaining assembly comprises moving the web retaining assembly relative to a mounting arm of the web diverter unit that is affixed to a frame of the turret unwind unit, such that the web diverter unit remains stationary relative to rotation of the turret arm when repositioning the running web material roll and new material roll upon performing of the splicing sequence.

* * * * *